United States Patent [19]

Woköck et al.

[11] 3,961,695

[45] June 8, 1976

[54] MANUALLY ACTIVATED APPARATUS FOR TIMING INTERVALS OF DIFFERENT MAGNITUDE

[75] Inventors: Ortwin Woköck, Schwenningen; Bernhard Kaiser, Villingen, both of Germany

[73] Assignee: Kienzle Apparate GmbH, Villingen, Germany

[22] Filed: May 9, 1974

[21] Appl. No.: 468,446

[30] Foreign Application Priority Data

May 10, 1973 Germany ..... 2323567

[52] U.S. Cl. ..... 194/83; 194/DIG. 22

[51] Int. Cl.[2] ..... G07F 17/24

[58] Field of Search ..... 194/DIG. 22, DIG. 21, 194/9 T, 20, 33, 46, 56, 62, 83

[56] References Cited

UNITED STATES PATENTS

| | | | |
|---|---|---|---|
| 2,304,012 | 12/1942 | Neff | 194/DIG. 22 |
| 2,369,688 | 2/1945 | Rhodes | 194/DIG. 22 |
| 2,618,371 | 11/1952 | Broussard | 194/DIG. 22 |
| 2,904,153 | 9/1959 | Kertell | 194/DIG. 22 |
| 2,916,127 | 12/1959 | Michaels | 196/61 |
| 3,828,907 | 8/1974 | Bock | 194/DIG. 22 |

*Primary Examiner*—Robert B. Reeves
*Assistant Examiner*—Joseph J. Rolla
*Attorney, Agent, or Firm*—Michael J. Striker

[57] ABSTRACT

A parking meter includes a timing unit, a coin receiver which can receive coins of different diameters, and a first and a second normally blocked lever which are biased for movement in mutually opposite directions about a joint axis of rotation into detecting engagement with a plurality of angularly spaced points on the circumference of the coin in the receiver, so as to detect the diameter of such coin. A manually operable arrangement serves to unblock the levers for their movement, and for subsequent joint angular displacement through a distance which is dependent upon the detected coin diameter. A control arrangement on one of the levers sets the timing unit to an interval whose length is a function of the aforementioned distance.

7 Claims, 12 Drawing Figures

Fig. 4
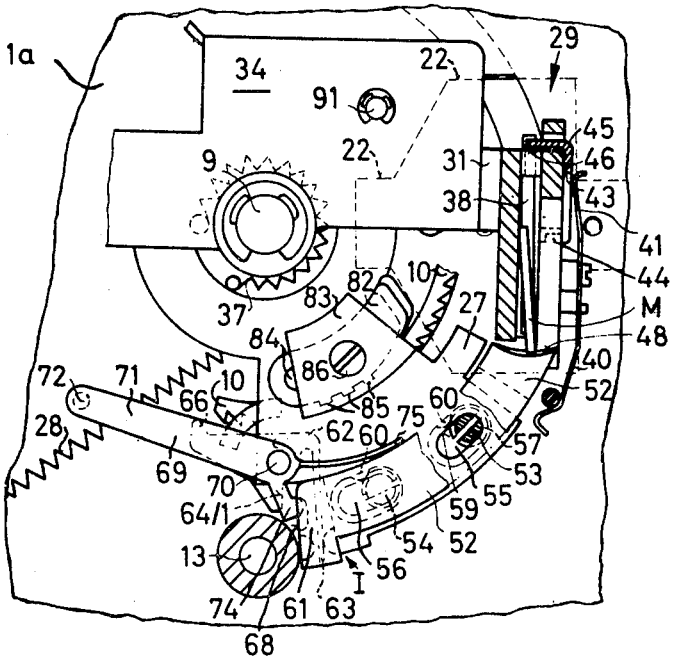
Fig. 4a
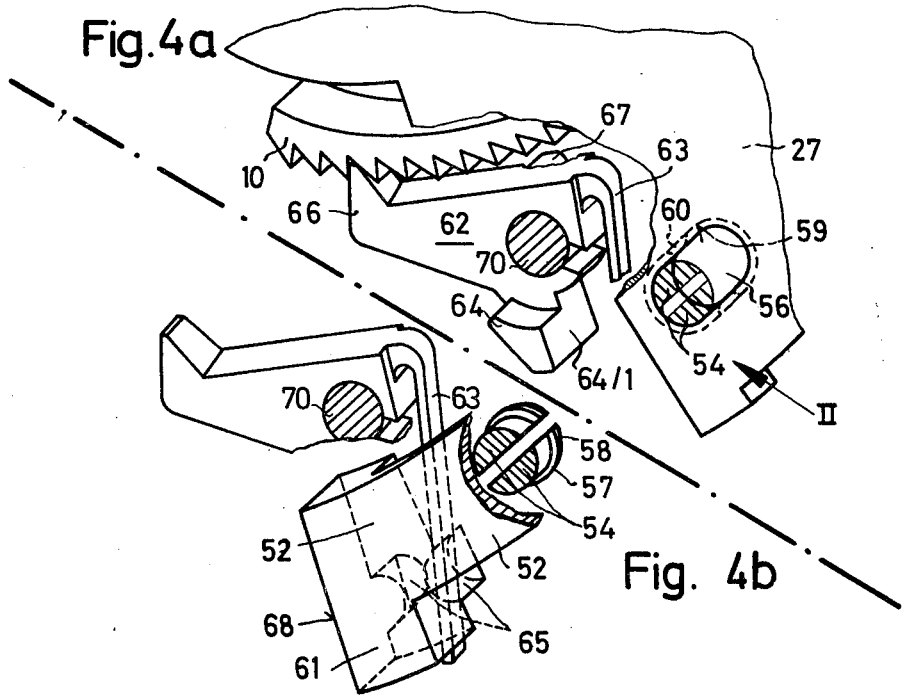
Fig. 4b

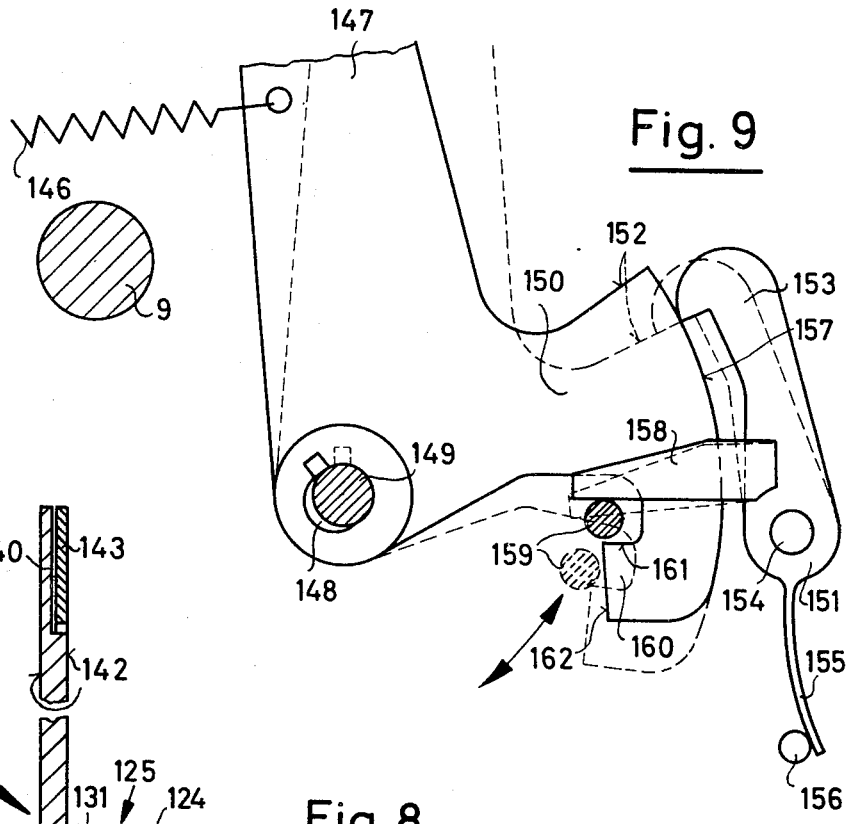
Fig. 9
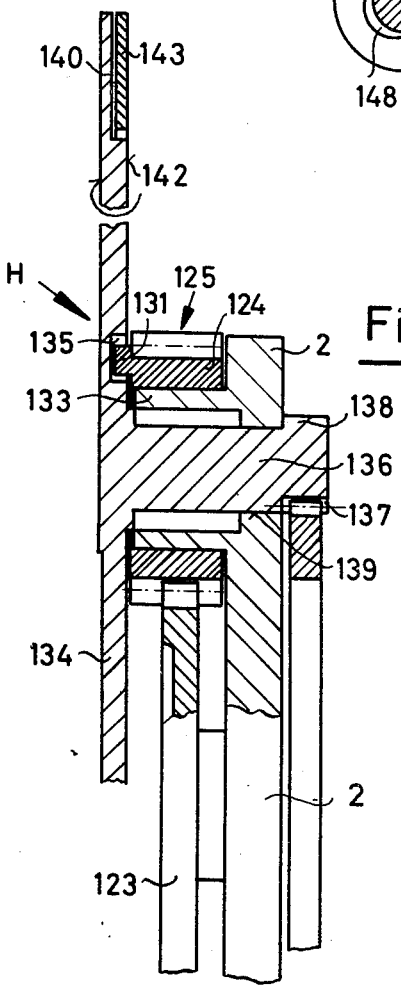
Fig. 8
Fig. 10
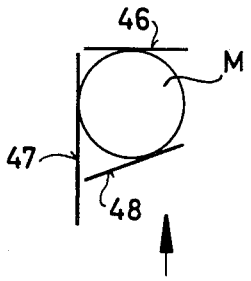

MANUALLY ACTIVATED APPARATUS FOR TIMING INTERVALS OF DIFFERENT MAGNITUDE

BACKGROUND OF THE INVENTION

The present invention relates generally to a manually activated apparatus for timing of intervals of different length in dependence upon a characteristic of an inserted coin. In particular, the invention relates to a parking meter which is manually operated.

It is emphasized that the present invention will hereafter be described with reference to manually operated parking meters, that is parking meters on which the "purchased" time will be indicated not in automatic response to the insertion of a coin, but only if a handle or the like is operated by a user after inserting the coin. However, it is evident that the present invention is usable in other contexts also, for example in connection with coin-operated childrens' rides, coin-operated games, and the like.

Parking meters are essentially of two basic types, namely the type in which a coin is inserted and the parking meter becomes activated and automatically set to a certain time interval, as soon as the coin has been inserted, found acceptable and identified as to its value upon which the length of "purchased" time will depend. The user need do nothing more than insert the coin. The other basic type of parking meter requires that the coin be inserted and that thereafter a lever, knob, handle or the like the turned or otherwise operated by the user. In this second type of parking meter, the time which is "purchased" again depends upon the identified value of the coin, but the timer of the parking meter will not begin to operate, and timing indication will appear on the parking meter, until the user has operated the parking meter handle. As has already been indicated before, the present invention is concerned with this second type of parking meter.

As a general rule, parking meters of this type are desired to be operable not only for a single time interval, e.g. for an hour, but for different time intervals e.g. a quarter hour, a half hour and an hour, which depend upon the value of the inserted coin. Thus, the insertion of a nickel may for instance purchase a 15 minute parking time interval, the insertion of a dime may purchase a half hour parking time interval, and the insertion of a quarter may purchase a one hour parking time interval, to take one example. It is, of course, possible to use a single type of coin and to make the parking time intervals additive; for example, the parking meter could be of the type which accepts only dimes and in this case the insertion of a first dime might purchase a 15 minute parking time interval, the insertion of an addition dime might purchase an addition 15 minute parking time interval, the insertion of a third dime might purchase still another 15 minute parking time interval, and so on. Another type of parking meter utilizes different coins for different time intervals, e.g. the aforementioned nickels, dimes and quarters. In all instances, however, the nominal value of an inserted coin is determined by measuring the dimensions of the coin, since these are most readily ascertainable in mechanical parking meters.

It is desirable that such parking meters be provided with arrangements which assure that no malfunctions occur, and especially with devices which permit the setting of a time interval on the meter only if the user moves the manually operable actuating lever or the like through the entire path of travel of the same, to avoid malfunctions which might arise from only partial movement of the lever.

One type of prior-art parking meter is disclosed in German Pat. No. 1,815,601 and can be operated with different-value coins each of which will purchase a different parking-time interval. The device can be changed to accommodate it to different-value coins and to different purchased time intervals, by replacing an entire series of internal components with others, in dependence upon the desired coin value change or time interval change that is to be effected. This requires that for each different type of coin, or for each different time interval that is to be paid-for by a particular coin, different components must be insertable into this prior-art apparatus. Particularly when it is assumed that such parking meters are to be readily adjustable for widely different circumstances, given the fact that different municipalities desire to set their parking meters so that coins of identical value will purchase different time intervals, or given the fact that it may be desired to deliver the parking meter to different countries having coins of different values, it is evident that the stock-keeping requirements for the replaceable components would have to be of such exceedingly large magnitude as to make it impossible to produce and sell parking meters of this type at an economically feasible price.

Moreover, this prior-art construction utilizes, in common with other prior-art constructions of this type, the concept of having individual coin inserting slots for three or more coins of different value. Of course, this requires that the user consider the special operating instructions which must go along with a parking meter of this type. In other words, the user must be certain to select the proper coin for the proper coin slot, in order to obtain a desired parking time interval. In many coinage systems it is customary that the higher-denomination coins are made of a more valuable metal than the lower-denomination coins, and are consequently of smaller dimensions. Evidently, such a coin can be readily inserted into a larger slot intended for a lower-denomination coin. Because of the construction of the parking meter, however, the inserted higher-denomination coin will not trigger the operation of the parking meter, when it has been inserted into the wrong slot, and in consequence the user will have lost the value of this coin without receiving a corresponding parking time interval in return. Since parking meters as a rule do not have a coin-return arrangement, the value of the inserted coin will be lost to the user.

A further prior-art parking meter is disclosed in German Pat. No. 1,474,749. This device, also, has three slots of different dimensions which can each accept a coin of different value. Interiorly, the device is provided with three diameter-testing arrangements, one each for testing a coin inserted through a particular one of the three slots. The testing of the coin diameters is carried out by cooperation of a plurality of arms or pawls which are formed with recesses of different depth in correspondence with the different coin diameters to be tested, located opposite to corresponding projections adjacent the respective coin inlet slot. The arrangement for testing the coin diameter is quite complicated. While the device can be re-adjusted for coins of different values, this requires the replacement of a number of cooperating components, which is difficult and requires that a large number of replacement components be kept in stock and available. Moreover, the possibility that a coin might be lost due to insertion into the wrong slot, without the user gaining the parking time for which he intended to pay, is not solved with this arrangement either.

SUMMARY OF THE INVENTION

It is, accordingly, a general object of the invention to overcome the disadvantages of the prior art.

In particular, it is an object of the present invention to provide an improved manually operated apparatus for timing of intervals of different length which are selected in dependence upon a characteristic of an inserted coin, especially a parking meter, which avoids the aforementioned disadvantages, and wherein a time setting can be obtained — even after insertion of a coin — only if the manual operating lever or the like is moved by the user through its complete path of travel.

An additional object of the invention is to provide such an apparatus which is of very simple construction, compared to the prior art.

Another object of the invention is to provide an improved parking meter of the type in question, which is capable of accepting and testing any inserted coin, and which will provide a timed interval corresponding to the value of the inserted coin, under all circumstances and without in any instance causing a user to lose an inserted coin or the equivalent time interval.

In keeping with the above objects, and with others which will become apparent hereafter, one feature of the invention resides, in a manually activated apparatus for timing with a timer intervals of different length which are selected in dependence upon a characteristic of an inserted coin which is identified by a coin tester, particularly in a parking meter, an improvement wherein the coin tester comprises a combination of a coin receiver adapted to receive coins of different diameter, and a first and a second normally blocked lever biased for movement in mutually opposite directions about a joint axis of rotation into detecting engagement with a plurality of angularly spaced points on the circumference of a coin in the receiver, so as to detect the diameter of such coin. Manually operable means are provided for unblocking the levers for the aforementioned movement, and for subsequent joint angular displacement through a distance which is dependent upon the detected coin diameter. Control means is provided on one of the levers for setting the timer to an interval whose length is a function of the aforementioned distance. The timer can be set, and the dial will indicate a timer setting, only if the manually operable means is made to traverse its complete path of movement.

In contradistinction to the prior art, the apparatus according to the present invention requires only a single coin inlet slot through which all coins that can be used with the apparatus, are inserted. This means that a user no longer has to determine into which of several slots a particular coin should be inserted; in consequence, the prior-art problem that a user might insert a coin into the wrong slot and the apparatus would not operate for a time interval corresponding to the value of the coin, is avoided. Evidently, this eliminates the possibility of losses which heretofore have been one of the primary difficulties in the use of the prior-art parking meters. In the apparatus according to the present invention, each and every inserted coin is supplied to one and the same testing arrangement which is capable of testing all inserted coins and which selects a "purchased" time interval in dependence upon the coin value that it has detected.

It is particularly advantageous that the present invention makes it possible to combine all the components required for receiving, testing and determining the value of an inserted coin in form of a separately producable assembly which can be mounted on a mounting plate of the apparatus, and that the time-selecting and timing components of the apparatus can be mounted as a second assembly group on a second mounting plate, with the two mounting plates being readily connectable. Such in arrangement makes for greater ease and simplicity of assembly, and this is further facilitated in that many of the components involved are of one piece and can be readily produced in a single operation of readily formable materials, so that the overall cost of producing the apparatus according to the present invention is significantly smaller than in the prior art. Hence, the apparatus according to the present invention can be produced and sold more economically.

The apparatus according to the present invention receives a coin that has been inserted through the single coin slot, in a cage-like component. When the manually operable means is operated, the coin which is initially loosely received in the cage-like component is shifted to a position in which it can be tested for its diameter and, hence, for its value. This position is obtained when the coin is engaged in testing relationship by three boundary surfaces bounding the interior of the carge, which surfaces are movable relative to one another and are inclined at predetermined angles. The surfaces assume, during the testing operation, an angular position relative to one another which is characteristic of the diameter of the inserted coin. In contradistinction to the prior art, the apparatus according to the present invention assures that the coin is engaged on at least three different circumferential locations, and an angular position of levers carrying the components involved is set in dependence upon the determined diameter of the coin. This makes it possible to determine very precisely the diameter of any type of coin. For instance, the apparatus according to the present invention permits a much more precise testing of the diameter of a precisely circular coin, due to the three-point engagement with the coin. Moreover, the invention also makes it possible to determine quite precisely the diameter of a non-circular coin, for instance the octagonal coins which are in use in some countries.

In the apparatus according to the present invention it is not necessary that any components be exchanged for others in order to re-adjust the apparatus for coins of different values, since adjustments can be made by simply re-setting certain components, that is changing their position, as will be discussed later.

The movement of the manually operable means away from its starting position results in automatic blocking of the coin inlet opening. This prevents any tampering with the operation of the mechanism through the coin slot, and assures that in the event several coins are to be inserted sequentially, each insertion is possible only if the operating sequence associated with a previous insertion (i.e. the time setting operation) is completely finished, because the slot will become unblocked only when the manually operable means moves to its operated position and thereupon is returned to its starting position.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 4 is an elevational view, partly in section, showing the coin processing unit and the coin-diameter testing unit, the latter being illustrated in its starting position;

FIG. 4*a* is a fragmentary, partly sectioned perspective detail view, showing a detail of the coin processing unit;

FIG. 4*b* is a view analogous to FIG. 4*a*, showing a further detail of the coin processing unit;

FIG. 8 is a fragmentary section showing details of the time selecting unit and the time indicating unit;

FIG. 9 is a partly sectioned detail view, showing a further detail of the novel apparatus; and FIG. 10 is a diagram, showing the principle of testing a coin diameter in accordance with the present invention.

DESCRIPTION OF THE PREFERRED EMBODIMENTS

Figure 1:
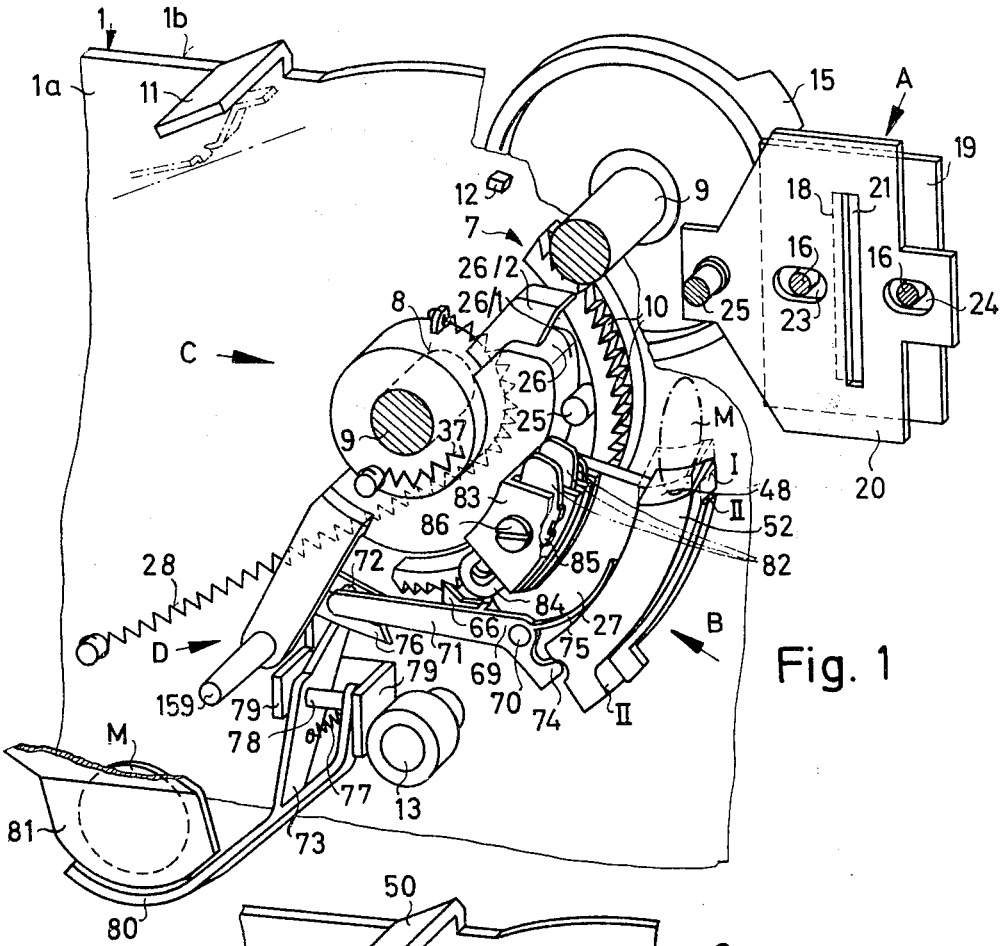
FIG. 1 is a partial view of the apparatus of the present invention, partly in section, showing the coin processing unit, the coin accepting unit, the control elements all of which together constitute an assembly group.

Before discussing the apparatus according to the present invention as illustrated in the embodiment of FIGS. 1–10, some basic observations will be helpful. It is pointed out, in particular, that the housing of the novel parking meter has been omitted, as well as the coin-collecting box into which an inserted coin drops after it has been found acceptable. Both housing and coin-collecting box are entirely conventional.

It is also pointed out that certain units will be identified throughout the specification with letter designations A–H, respectively. Character A will identify the coin accepting unit, B will identify the coin-diameter testing unit and C will identify the coin processing unit. D will identify control elements associated with the coin processing unit. E will identify testing elements for testing the coin diameter, F will identify the time selecting unit which selects the time that has been "purchased" with a coin of a certain value, G will identify the timing unit per se which will time the selected interval, and H will identify the indicating unit which indicates to the user the time that has been purchased by the insertion of a coin of a certain value. These are broad designations, and detailed descriptions of the components associated with these units and elements will be provided with reference to the various Figures. The timing unit G is a conventional timer as found in prior-art parking meters (e.g. U.S. Pat. No. 3,506,102) and is therefore only diagrammatically shown in the various Figures.

Basically, the apparatus according to the present invention uses two mounting plates 1 and 2 (compare FIGS. 1 and 6) each of which carries an assembly composed of several of the various units. This makes for a simple manufacture and mounting of the two assemblies, and to complete the final assembly of the apparatus it is merely necessary to connect the two plates with one another so that the assemblies carried by the respective plates 1 and 2 will come into cooperative relationship.

In order to obtain an economical and compact construction and optimum operation, all components which constitute part of the coin processing unit C are mounted on one of the mounting plates, here on the mounting plate 1 which faces the manually operable element, namely the knob or handle 15. The components associated with the coin processing unit C are illustrated in FIGS. 1–5 and include the coin accepting unit A, the coin-diameter testing unit B with its testing elements E, and the control elements D which initiate the selection of time and the operation of the timer in dependence upon the identified value of an inserted coin. The cooperation with the assembly on the second mounting plate 2, namely the time selecting unit F, the timing unit G and the indicating unit H, is effected by means of pivotable pawls 100, 101 and 102.

The second assembly composed of the units F, G and H which are mounted on the mounting plate 2, is illustrated in more detail in FIGS. 6–9.

To connect the two assemblies with one another, the mounting plates 1 and 2 are provided with projections 3 (see FIG. 6) which may be of one piece with them and which have centering and retaining portions 4, 5 and 6 (see FIG. 3) which assure that the two assemblies will assume a predetermined fixed relationship relative to one another when the two mounting plates 1 and 2 are connected.

Referring now firstly to FIG. 1 it will be seen that all components of the coin processing unit C and associated elements are exclusively mounted on the mounting plate 1. the latter is formed on its inwardly facing side 1*a*, that is the side facing away from the knob 15, with a gear segment 7 that is of one piece with the mounting plate 1 and serves to block return movement of the arrangement, in the manner still to be discussed later. This segment 7 projects from the inner side 1*a* and is arcuately curved and concentric with reference to a bore 8 through which the operating shaft 9 extends. The segment 7 is provided with teeth 10. Also of one piece with the mounting plate 1 are ejecting portions 11 and 12 and abutments 13 and 14 (compare FIGS. 1 and 2) and 36, which cooperate with movable components of the coin processing unit C. The front side 1*b* of the mounting plate 1, that is the side facing towards the knob 15, is provided with guide faces 22 (see FIG. 4) which engage and guide a movable cover 20 of the coin accepting unit A.

Details of the coin accepting unit A are shown in FIG. 1, from which will be evident that this unit A is mounted on the side 1*b* of the mounting plate 1 which faces towards the user, that is the side at which the knob 15 is located. The knob is mounted on the shaft 9 so as to turn the same when the knob is turned. The unit A includes a removable outer or cover plate 19 which is mounted on the mounting plate 1 by means of screws or similar mounting elements 16. The plate 19 is formed with a single slot-shaped opening 18 whose length and width corresponds to the diameter and width of the largest coin which the apparatus is intended to accept. The coin is identified throughout the drawing with reference character M. Evidently, by having only a single coin inlet opening 18, the difficulties associated with the prior art, when coins of a certain value were inserted into a slot intended for a coin of a different value, are avoided with the construction according to the present invention.

A movable cover 20 is provided which is located behind the outer plate 19 and which is provided with a slot-shaped opening 21 identical to the opening 18. The cover 20 can be moved with reference to the plate 19 to and from a position in which the openings 18 and 21 are in full registry with one another, so that a coin M can be inserted through the two of them. The movable cover 20 is provided between the guide faces 22 for the aforementioned sliding movement, and this guidance prevents any movement of the opening 21 to a position in which it might be skew with reference to the opening 18. Elongated openings 23 and 24 are provided in the movable cover 20, and the screws or analogous elements 16 extend through the openings 23 and 24 and are secured in the mounting plate 1. A follower 25 is provided on the movable cover 20, extending transverse to the direction of movement of the latter and passing through a cutout in the mounting plate 1, to extend axially into a cam track 26 which is formed on a lever 27.

FIGS. 4 and 4*a* show particularly clearly that the lever 27 is mounted on the shaft 9 so as to turn with but not relative to the same, and that it can be turned by turning of the handle or knob 15 (in counterclockwise direction in FIG. 1) through a certain angular distance against the restoring force of a restoring spring 28. When the cam track 26 is in the starting position, which is also the starting position of the coin processing unit C, the follower 25 is located in a first surrounding part of the cam track 26, in which the follower 25 is held in one of its two positions, namely the lower extreme position. In this case, the coin accepting unit A is automatically ready to accept a coin M, that is the openings 18 and 21 arre in full registry with one another. As the drawing shows, the cam track 26 curvature increases radially over only a few degrees of arc by an extent which is necessary to assure that in cooperation with the follower 25 it shifts the movable cover 20 to the other extreme end position, in which the opening 21 is out of registry with the opening 18 and the insertion of coins into the coin accepting unit A is impossible. Immediately following this portion of the cam track 26, the latter is formed with a concentric arcuate portion 26/1 which is to configurated that during further movement the movable cover 20 will remain in its coin-blocking position, so that the cover 20 can return to a position in which its opening 21 is in registry with the opening 18, only when the knob 15 is subsequently returned (in clockwise direction in FIG. 1) to its starting position, during which movement the portion 26/2 of the cam track 26 engages the follower 25 and shifts the same and thereby the movable cover 20, back to the starting position in which the openings 18 and 21 are in registry and permit the insertion of another coin.

Figure 2:
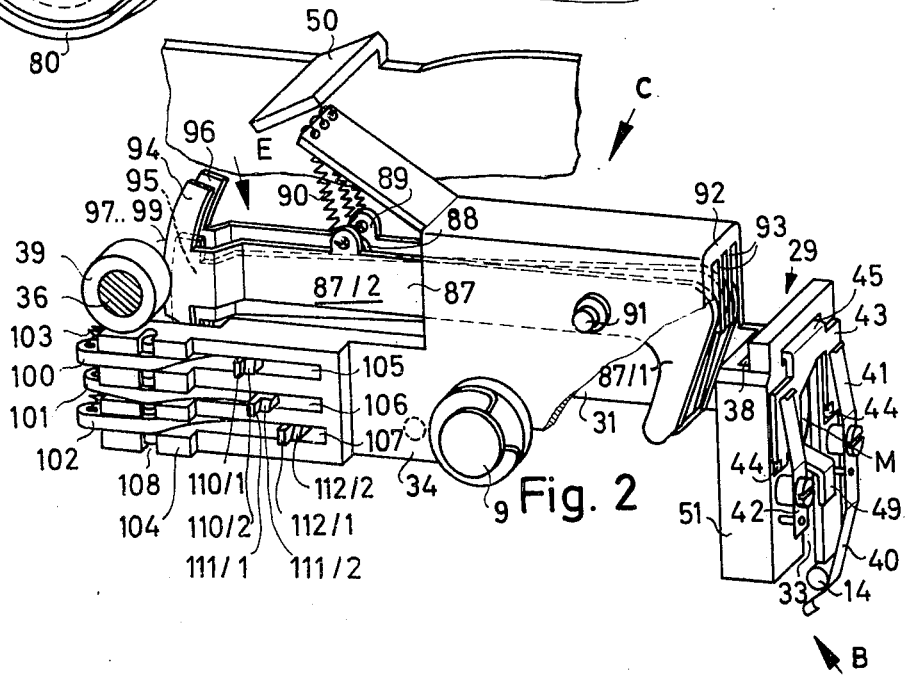
FIG. 2 is a fragmentary perspective view of a coin-diameter testing unit which is part of the coin processing unit.
Figure 3:
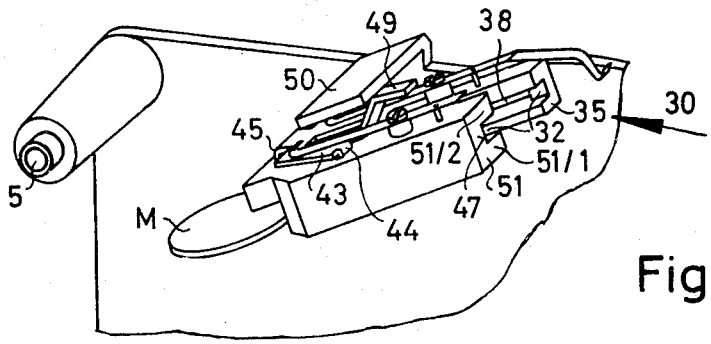
FIG. 3 is a fragmentary perspective view showing a detail of the coin accepting unit.

When the knob 15 is in its starting position, the coin-diameter testing unit B is located immediately inwardly behind the openings 18, 21. It is suitable for testing all of the coins that can be accepted by the apparatus, that is all of the coins that can be inserted through the openings 18, 21. The unit B constitutes a part of the coin processing unit C and has the purpose of accepting an inserted coin M, and to determine its value. The value is determined as a function of the determination of the coin diameter. As FIG. 10 shows diagrammatically, the coin diameter is determined by engaging the coin M at three circumferentially spaced locations of its periphery by means of mutually inclined abutment faces 46, 47 and 48, of which the latter is movable toward and away from the abutment face 46. FIGS. 2, 3 and 4 show more clearly that these abutment faces bound an interior space of an essentially cage-like structure 29. It is emphasized that the inclined arrangement of at least one of the abutment faces, namely an abutment face 48, with reference to the other abutment faces 46, 47 has an advantage over the prior-art teachings of moving two parallel abutment faces into engagement with diametrally opposite points on the periphery of a coin, in that it not only provides for a determination of the diameter of a circular coin, but also makes it possible for the apparatus to distinguish between circular and polygonal coins, such as for instance the octagonal ones used in certain countries.

FIG. 3 shows that the cage-like structure 29 is formed by a U-shaped profiled member 30 which is mounted on an arm 31 of a lever 34, as most clearly shown in FIG. 2. The U-profiling faces inwardly and its open side faces downwardly; that is the inner sides of the arms and bight of the member 30 are formed with the slot-shaped recesses 32, and the open side of the overall U-shaped configuration faces downwardly. One arm 35 of the member 30 is located directly behind the opening 21 due to the fact that the lever 34 is normally maintained in engagement with the abutment 36 by a biasing spring 37. This arm 35 is formed with a cutout 38 corresponding in its dimensions to the dimensions of the openings 18 and 21 and which extends into the bight portion. A cover 39 of vibration and sound damping material, e.g. rubber or rubber-like synthetic plastic material, is applied onto the abutment 36 for obvious reasons. A double-armed leaf spring 40 is provided, one arm of which maintains the lever 34 in the starting position thereof against an abutment 14 as shown in FIG. 2, whereas a second arm 41 of the spring 40 cooperates with an additional leaf spring 42 to act upon a coin detent member 43. The latter is pivotably mounted on the member 30 by means of angled mounting portions 44 and has a further right-angular portion 45 which extends into the cage-like structure 29 (see FIGS. 2, 4) and is provided with the abutment face 46. A radially extending control arm 49 is provided on the coin detend 43; when the lever 34 turns with the shaft 9, the arm 49 will in the terminal phase of this turning movement engage a stationary abutment 50 of the apparatus, whereby the coin detent 43 is pivoted in clockwise direction (FIG. 3) counter to the biasing effect of the spring 40, 42. This results in a retraction of the abutment face 46 out of the cage-like structure 29, so that the coin M can now pass through the thus-opened side of the cage-like structure 29 under the pushing influence of the lever 27. At the moment of ejection the coin M receives a certain amount of acceleration due to the released force of the spring 37 with reference to the levers 27 and 34.

The second abutment face 47, which extends substantially at right angles to the abutment face 46, is formed by an arm 51 of the member 30 which is located opposite the inlet opening 38 in the arm 35. It is provided with a groove 32 which is bounded by the portions 51/1 and 51/2, so as to guide an inserted coin M in order to assure that the latter is placed by the action of the lever 27 into a proper test position intermediate the abutment faces 46, 47 and 48. The latter is concave and the coin M rests on it once the coin has been inserted into the structure 29. The abutment face 48 is inclined at an acute angle with reference to the faces 46, 47 and is movable relative to the same, as indicated by the arrow in FIG. 10 and as shown in FIGS. 2, 3 and 4 in particular. The abutment face 48 is provided on a slide member 52, as will be described later.

This arrangement of the abutment faces thus provides for a determination of the coin diameter by engagement of the coin periphery at three circumferentially spaced points when the coin is in a certain predetermined orientation, and thus makes possible an exact determination of the coin diameter by the summation of several individual items of information. The summation of the three items of information obtained by engaging the coin M at three distinct locations causes a certain angular position of the levers 27 and 34 relative to one another, which levers carry the abutment faces 46, 47 and 48. This angular position can be obtained by operating the knob 15, that is by turning it counterclockwise in FIG. 1 after the coin has been inserted. Due to the constant biasing force of the spring 37, which exerts a biasing action on the levers 27 and 34 in mutually opposite directions, the once-set relative angular position of the levers 27 and 34 is maintained.

As pointed out before, the abutment face 48 is formed on a slide member 52; the latter is pivotable on the lever 27 and arrestably displaceable between two end positions I and II (FIGS. 1 and 4). The slide member 52 is of one-piece construction and is formed with projections 53 and 54 which are flexible, that is whose diameter can be varied due to the fact that they are provided with axial slots. The projections 53 and 54 serve to mount slide member 52 for movement in the operating direction, for which purpose they extend into arcuately curved elongated openings 55, 56 formed in the lever 27. The free end of each of the projections 53, 54 is formed with an enlarged head 57 of increased diameter, which has a conical portion 58 as shown in FIG. 4*b*. They not only serve to mount the slide member 52 for sliding movement, but also serve to obtain an arresting effect, to provide an axial retention of the slide member 52 against separation from the lever 27, and serve to fix the slide member 52 in its respective end positions I and II. For the latter purpose, at least one edge 59 bounding the respective slots 55, 56 is formed with a projection 60 over which the associated projection 53, 54 must slide under simultaneous temporary diameter reduction, which is possible because of the slots formed in the projections 53, 54.

The initial function to be performed by the apparatus according to the present invention, upon turning of the knob 15 from the starting position thereof, is to determine whether or not a coin M is present in the coin-diameter testing unit B, or whether the knob 15 is being turned without a coin having previously been inserted. To make such a determination possible, the slide member 52 is in operative connection with control members 62, 69 of the coin processing unit C, in such a manner that in dependence upon the presence of an inserted coin M the slide member 52 can be displaced, by turning of the knob 15, from its first position I into a second position II. This displacement permits cooperation between the control member 62 and the teeth 10 of the tooth segment 7, which together constitute a blocking arrangement against a return movement of the knob 15, and also permits cooperation between the control member 69 and the coin holding member 73 which together act to transport the inserted coin M into the (non-illustrated) coin collecting box. When the coin M has been ejected from the cage-like element 29, the slide member 52 returns the control member 62 to the original position thereof, as the slide member 52 itself returns to its starting position I. The lever 27 is maintained in its starting position by the restoring spring 28, in which it engages the abutment 13 via an interposed portion 61 of the member 52. The latter is automatically movable to its first position I as a result of its engagement with the abutment 13 (see FIG. 4), and this first position corresponds to an angular displacement of the slide member 52 through a predetermined angular distance in the operating direction. The end of the slide member 52 remote from the abutment face 48 is provided with elements which serve to operate the control members 62 and 69. The control member 62 constitutes a part of the earlier mentioned blocking arrangement against reverse movement, and the control member 69 together with the member 73 constitute a transporting arrangement for transporting the coin M. Both of these become operative only in dependence upon the insertion of a coin M into the unit D, and the operation of the knob 15. Only after the unit C has completed its own operation, can the control member 62, 69 and the slide member 52 be returned to their starting position in which another coin can be inserted into the unit A.

The blocking arrangement for blocking the return movement utilizes the aforementioned control member 62 which is of one piece and which is constructed with a resiliently yieldable arm 63 and with two cams 64 and 67, as shown in FIGS. 4, 4*a* and 4*b*. The control member 62 is turnably mounted on the lever 27 on a pin 70, and via the arm 63 it is in engagement with a bifurcated bracket 65 of the slide member 52, so that when the slide member 52 is moved to its position II the tip 66 of the control member 62 can be moved into biased engagement with the teeth 10, thus preventing a return movement of the unit C from an intermediate position into the starting position thereof, and permitting only a further forward movement to the operated position. Only after the operated position has been reached, that is when the knob 15 has been turned (in counterclockwise direction in FIG. 1) until it can no longer turn, can the cam 67 engage the member 12 and displace the control member 62 out of engagement with the teeth 10. At the same time the member 62 cooperates via the part 64/1 of the cam 64 with the trailing end 68 of the slide member 52, returning the latter to its starting position I.

The control member 69 is also of one piece, being constructed as a multi-armed pivoting lever which is also mounted on the pin 70 of the lever 27, and which is in engagement with the slide member 52 (see FIGS. 1 and 4) by means of its arm 74 and a leaf spring portion 75 which is of one piece with the member 69. A further arm 71 of the member 69 is so arranged that a projection 72 at its free end will move during pivoting of the arm 69 into the range of operation of a coin holding member 73 (see FIG. 1.) When the slide member 52 moves to its second position II, the lever 69 will automatically be pivoted in such a manner that the projection 72 will cooperate with an inclined surface 76 of the coin holding member 73 which is biased by a spring 77 to a normal rest position. The member 73 is mounted on a pivot 78 in a fixedly mounted bracket 79 and is provided with a portion 80 which can be tilted transversely to the direction of coin movement. The bracket 80 can be tilted out of the coin channel due to the displacement by the control member 69, so that a coin M which is located on the bracket 80 is now free for passage to the non-illustrated coin collecting box.

A plurality of followers 82 is provided on the lever 27, and these have the purpose of accommodating the coin processing unit C to any coin size that can be detected by the coin-diameter testing unit (see FIGS. 1 and 4). In other words, when one of the followers 82 is set to an associated coin size, a displacement distance can be preselected which corresponds to the value of the coin size. This setting is in a certain relation to the relative angular position of the lever 27 and the lever 34, which is in turn determined by the size of the coin in the coin-diameter testing unit B.

Figure 5:
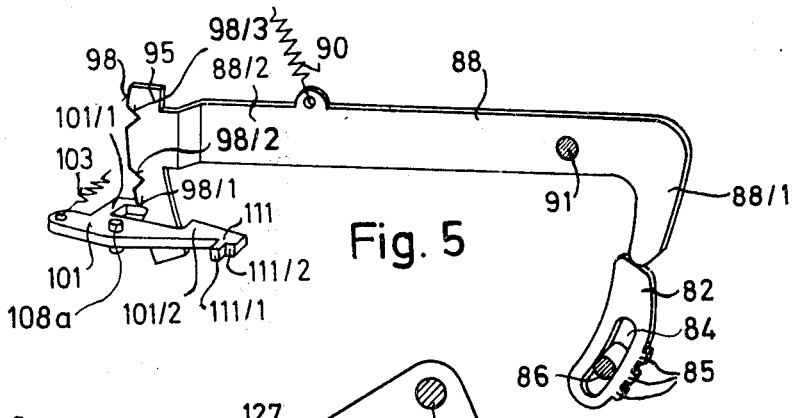
FIG. 5 is a perspective view, showing a detail of the coin processing unit.

The lever 27 is provided with a portion 83 in which a plurality of the followers 82 is mounted. The followers 82 are configurated as arcuate segments provided with an elongated opening 84 and are provided at their outer circumference with teeth 85 as shown in FIG. 5. These teeth serve as engagements when the frictionally retained segments 82 are set by means of tools, whereafter the segments can be jointly fixed in their selected predetermined relation by tightening of a single mounting member 86, as shown in FIGS. 1, 4 and 5.

The lever 34 also carries as testing elements E a plurality of double-armed testing levers 87, 88 and 89 which are turnably mounted on a common shaft 91 (see FIG. 2), being permanently biased to a rest position by springs 90. A slotted guide portion 92 of the lever 34 is formed with partitions 93 located in the region of the shaft 91 and the short lever arms of the double-armed testing levers 87, 88, 89; this is for the purpose of assuring that the levers 87–89 are precisely guided and are independent of one another. The levers 87–89 can be turned about their shaft 91 and are additionally movable together with the lever 34 in dependence upon the operation of the knob 15, about the shaft 9. The testing levers 87–89 are so arranged, with reference to the respectively cooperating followers 82, that one lever arm 87/1, 88/1 and 89/1 is always located in the path of movement of the associated follower 82, as is shown in FIG. 5. Contacting of the followers 82 of the lever 27 with the respective testing levers 87–89 of the lever 34 displaces the levers 87–89 individually through a predetermined angular distance. The degree of such displacement is dependent firstly upon the relative positions of the levers 34 and 27, and secondly upon the specific setting of the follower elements 82 on the lever 27. The first condition is determined by the size of a coin M located in the coin-diameter testing unit B, whereas the second condition is predetermined by the manner in which the followers are set. The sum of the two conditions determines whether or not a coin M is acceptable for setting a time parking interval.

In order to be able to obtain a clear determination as to whether or not a coin can be used, even though minute diameter differences might exist in the inserted coins M, the ends of the second lever arms 87/2, 88/2 or 89/2 of the testing levers 87–89, respectively, are formed with segment-shaped portions 94, 95 and 96 (see FIG. 2) whose periphery, related to the pivot pin 91 are constructed as arcuate cam tracks 97, 98 and 99. These cam tracks are interrupted at certain points by one or more notches, for example 98/1, 98/2, 98/3 in FIG. 5. To be able to obtain an optimum resolution of small diameter differences from the preset acceptable diameter of a coin M, the ratio of the length of the first lever arms 87/1–89/1 to the second lever arms 87/2–89/2 of the testing levers 87–89 is a multiple. This means that small diameter differences which are measured will result in a direct translation in terms of large control cam displacements. By an appropriate location of the several notches 98/1–98/3 (FIG. 5) any one of the testing levers (here the lever 88) makes it possible to test different coin sizes. A double-armed pawl 100, 101 or 102 cooperates with the periphery of each of the control cams 97–99, each of the pawls being biased by a respective spring 103 (see FIGS. 2 and 5). One arm 100/1–102/1 of the respective pawls 100–102 is in engagement by the force of the spring 103 with the associated control cam 97–99, so that it slides over the same. This means that the other arm 100/2–102/2 at the same time is in engagement with an arrangement for setting a time selecting unit F. The lever 34 is provided with an arrangement for mounting the pawls 100–102, namely the pawl mount 104 which is formed by providing a plurality of slots 105, 106 and 107 which are formed in the lever 34 axially with reference to the shaft 9 and which have a length and a width permitting the pawls 100–102 to be readily inserted into the respective slots 105–107. Transverse to the slot 105–107, approximately tangential to the control cams 97–99, a recessed cutout 108 is formed which serves as a bearing for the mounting pins **108*a* provided on the pawls 100–102. The pawls 100–102 are insertable from the open side of the cutout 108 into the associated slots 105–107, and they are held turnably in these slots by means of the springs 103. The length of the arms 100/1–102/1 is so selected that these will cooperate in predetermined sequence with the control cams 97, 98 and 99. If one of the arms 100/1–102/1 engages in the displaced position of the associated control cam 97–99 one of the notches, for instance the notch 98/1–98/3, then the other arm 100/2–102/2 is in engagement (under the urging of the associated spring 103) with the elements for setting the time selecting unit F. For this purpose the arms 100/2–102/2 are each provided with a projection extending in the direction of displacement. These projections are each composed of a finger 110/1–112/1 and a radially and laterally recessed tooth 110/2–112/2. The length of the arms 100/2–102/2, and the arrangement of the projections with respect to the distance to the turning axis of the pawls 100–102 can be so selected that the pawls 100–102** come into engagement with the elements for setting the time selecting unit F.

Figure 6:
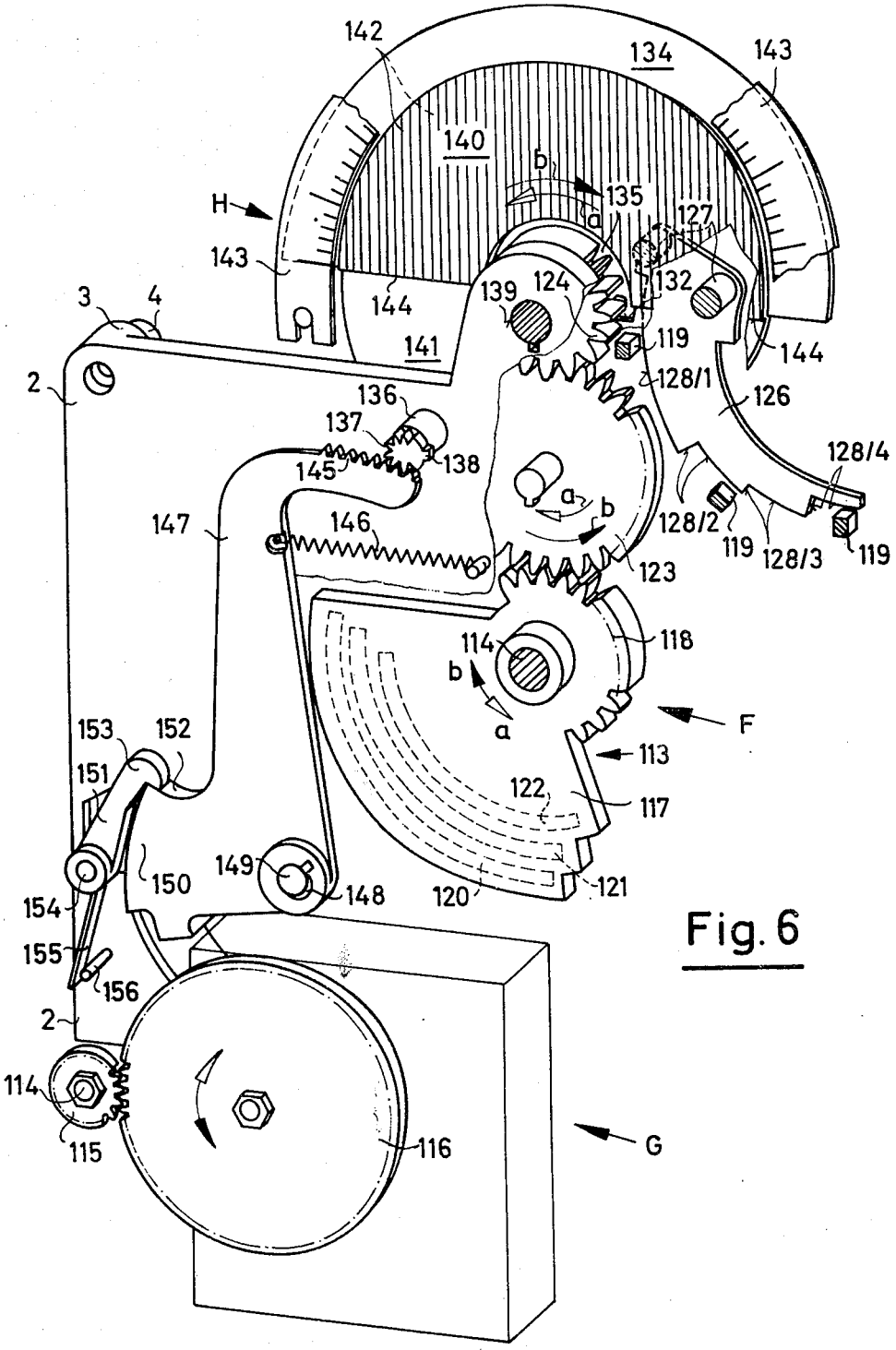
FIG. 6 is a perspective view, partly in section, showing parts of the time selecting unit and of the time indicating unit, which together constitute another assembly group.

These elements can be constructed as a link between the time selecting unit F and the coin processing unit C, as a part of the assembly on the mounting plate 2. These elements can utilize a cam segment 113 which is fixedly mounted on a shaft 114 as shown in FIG. 6, the shaft 114 in turn being mounted in the mounting plate ting engagement via a replaceable fixedly mounted gear 115 with a similarly replaceable gear 116 which drives the timer G. By making the gears 115 and 116 replaceable, different transmission ratios between the angular displacement of the cam 113 and the setting of the timer G can be obtained.

Figure 7:
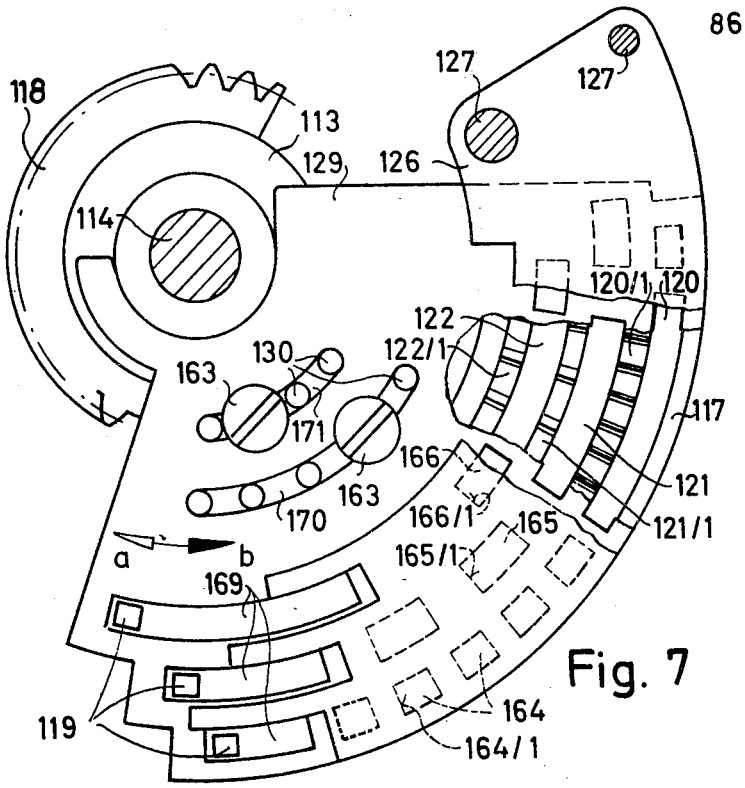
FIG. 7 is an elevational view, partly in section, showing details of the control of the time selecting unit.

The cam 113 has a plate portion which is subdivided into two angular segments 117, 118, as shown in FIGS. 6 and 7. The angular segment 117 is provided in correspondence with a number of the pawls 100–102 with concentric axially recessed cam tracks 120, 121 and 122 which are radially spaced and whose separating portions, that is the portions which separate them from one another, are provided with teeth 120/1, 121/1, 122/1 of any desired configuration and number. One each of the cam tracks 120–122 and an associated set of teeth 120/1–122/1 cooperate with the projections 100/1, 110/2, etc. of a released pawl 100–102, respectively. The movable abutments 119 may be inserted at selectable angular distances into the cam tracks 120–122, to thereby predetermine a first displacement distance of the cam 113. When, subsequently to movement of cam 113 through one of the first displacement distances, a further or additive setting of the cam 113 takes place, then this results exclusively via the engagement of the respective tooth 110/2, 111/2 or 112/2 of one of the projections 110–112 with the associated teeth 120/1–122/1. The arrangement and the number of teeth of the sets of teeth 120/1–122/1, as well as the position of the removable abutments 119, have a certain relationship to the scale-type indicating unit H and the time-storage capacity of the timing unit G.

It is desirable to make the relation between the displacement of the cam 113 by one of the projections 110–112, variable with respect to the preset angular distance. To make this possible, a fixedly mounted guide member 126 is located between the projections 110–112 on the one hand and the cam tracks 120–122 with the associated sets of teeth 120/1–122/1 on the other hand, as shown in FIGS. 6 and 7. This guide member 126 can be replaced with another one, for which purpose it is mounted via two spacers 127 and appropriate screws or the like on the mounting plate 2. The arrangement and construction of the guide member 126 makes it possible to control cooperation of the projections 110–112 with the cam 113 in a staged sequence, in such a manner that related to the starting position of the cam 113, the finger 110/1–112/1 of a projection 110–112 may extend during a first displacement stage into the range of engagement of an appropriately pre-set removable abutment 119. During a following second initiation of displacement of the cam 113, or generally if the cam 113 is in a position other than the starting position, the controlling influence of the guide member 126 permits a tooth 110/2–112/2 to act in engagement with the associated set of teeth 120/1–122/1. Due to the two possibilities (controlled via the guide member 126) for each of the projections 110–112 to engage with an associated cam track 120–122 or set of teeth 120/1–122/1, the angular displacement possibilities that can be obtained can be freely selected for different distances. To make this possible in a simple manner, the guide member 126 is in form of a flat segment-shaped part which is accommodated to the shape of the tracks 120–122 with radially spaced cutouts 128/1–128/4 which have certain angular lengths and which, in accommodation to the desired selectable timing intervals, permit predetermined angular segments of the cam tracks 120–122 to be engaged by the fingers 110/1–112/1 or the teeth 110/2–112/2.

The length of the timing intervals that can be selected can be made further variable in that control segments 129 are provided which are engageable with the cam 113, and by means of which additionally the sets of teeth 120/1–122/1 of the cam 113 can be totally or partially covered against engagement by the projection 110–112. As shown in FIG. 7, the cam 113 is provided with bores 130 which serve to receive screws or similar connectors 163 that extend through elongated slots 170, 171 in the control segments 129. By an appropriate covering of the sets of teeth 120/1–122/1, the teeth 110/2–112/2 cooperating therewith either cannot engage with these sets of teeth, or can engage only over certain predetermined angular distances with the same, so that subsequent to a first setting of a time interval in accordance with the arrangement outlined earlier, a second time segment can be selected on the basis of a non-additive, a degressive or even a progressive angular-range displacement.

One of the control segments 129 for e.g. a non-additive angular-range displacement is shown by way of example in FIG. 7. The term non-additive angular-range displacement is intended to mean that the cam 113 can be turned for setting purposes only over a distance corresponding to an entire time interval. In other words, assuming that a time interval had previously been selected by the insertion of a coin, and that a part of this time interval has expired (e.g. one-half hour of a selected time interval of one hour), and if the same value coin is again inserted, then the cam 113 can move (when the knob 15 is turned) only through a distance corresponding again to another hour. For this purpose the control segment 129 is so constructed that the sets of teeth 120/1–122/1 are covered, and thus cannot cooperate with the teeth 110/2–112/2 of the pawls. In order to be able, despite this, to select several full time intervals, the control segment 129 is provided with cutouts 169, 164, 165 and 166 which are arranged in the region of operation of the fingers 110/1–112/1 and at angular distances which correspond to the desired hole-interval displacements. The cutouts 169, 164–166 are therefore located on the control segment 129 in concentric paths and correspond to the tracks 120, 121 and 122 of the cam 113, that is they are located on the same radii as the curvature of those tracks. The finger 110/1–112/1 of a released projection 110–112, respectively, slides during the time setting movement first without effect over the guide member 126, until it reaches the end of the guide member surface and can now enter through the cutout 169, 164–166 which follows next in its direction of movement, into the corespondingly associated track 120–122. A left-hand (in FIG. 7) abutment edge 164/1, 165/1 or 166/1 of the cutouts 164–166 takes the cam 113 along in cooperation with a finger 110–112, respectively, in a sense setting the selected time on the unit F.

The embodiment of the cam shown in FIG. 6 is exemplary and shows for instance that the entire time setting range can be subdivided into three ranges, each having different subdivisions of the maximum selectable time. The term maximum selectable time refers to the maximum time period that can be set on the timing unit G, for instance five hours, one hour or whatever the time may be. In FIG. 7 the segment 129 is so constructed that, as the distribution and number of cutouts 169,

164–166 indicates, the entire range of time interval setting is subdivided into twelve, six and three partial regions. However, it is quite clear that by appropriately configurating the guide member 126 and, in special cases (for instance for nonadditive progressive or degressive time setting) by means of the control segment 129, any desired preselection of time intervals can be obtained.

The control segment 129 can be adjusted as desired, due to the arcuate openings 170, 171 and the aforementioned screws 163 or analogous connecting members, so as to assume a desired position with reference to the cam 113. Such an adjustment is advantageous for accommodating the time selecting unit F to the indicating unit H.

To obtain a transmission of an angular movement to the indicating unit H, the segment portion 118 of the cam 113 is configurated as a toothed segment in this embodiment, which transmits (as shown in FIG. 6) the movement of the cam 113 via the gear 123 to a pre-setting device 125 (FIG. 8). This device utilizes the gear 124 and an axially projecting abutment 131 thereon, which extends into the range of engagement of an abutment 132 (FIG. 6) on a time indicator. The gear 124 is turnable coaxial with reference to the indicating unit H, being mounted on a tubular portion 133 of the mounting plate 2. With respect to the time selecting direction *a* the gear 124 is in driving engagement with the cam 113, and oppositely (with respect to the time expiration movement *b*) it is in driving engagement with the timing unit G. The projection 131 extends into a groove 135 which is concentric to the mounting of a time indicator disc 134, and one end of which constitutes the aforementioned abutment 132, as shown in FIGS. 6 and 8. The disc 134 is provided of one piece with a shaft portion 136 which is formed with teeth 137 and an axial detent in form of a radial projection 138. The shaft portion 136 journals the disc 134 turnably in a bore 139 of the mounting plate 2. The disc 134 itself is subdivided into two parts, of which one part is identified with reference numeral 140 and has a greater radius than the other part 141. The part 140 is a dial provided on both sides with a clearly defined marking 142, for instance an appropriate color or the like. The part 140 with the greater radius covers at one side a scale 143 which indicates the time in minutes or in any other desired increments, or it affords a view of the scale 143, or in particular of that portion corresponding to a preselected time which is dependent upon the value of the inserted coin M. On the other side of the apparatus the dial edge 144, which may be of a different color or the like, symbolically performs the function of a pointer or indicator, marking the expired time or the still to expire time on the scale 143.

Teeth 145 of a drive segment 147 are in engagement with the teeth 137; the drive segment 147 is biased by a spring 146 and tends to bias the disc 134 in time-setting direction, as shown in FIG. 6. The drive segment 147 is formed with a substantially kidney-shaped elongated opening 148 (FIG. 9) through which a fixed pin 149 of the mounting plate 2 extends, so that the drive segment 147 is turnable and pivotable thereon. An arm 150 of the segment 147 cooperates with the locking pawl 151, in such a manner that the pawl 151 can engage past an edge 152 of the segment 147 (FIGS. 6 and 9) under spring tension when the segment is in the starting position, which corresponds to the zero posi- FIGS. 6 and 9 show that the pawl 151 is provided with a hook-shaped portion 153 and is turnably mounted on a bolt 154 of the plate 21. The pawl is further provided with a springy arm 155 which engages under tension a fixed abutment 156 of the mounting plate 2. In a position of the time indicating unit H wherein a not-as-yet expired time is being indicated, the portion 153 engages an arcuate edge 157 of the arm 150 of the segment 147. To be displaced out of its latching position the pawl 151 has a further arm 158 which extends into the range of movement of a finger 159 of the lever 27; this finger 159 travels during turning of the knob 15 from its starting position to its end position (see the arrow in FIG. 9), and during the return movement it moves under the influence of the restoring spring 28. In the starting position of the knob 15 the finger 159 is in a position in which it presses against the arm 158 and due to the thus obtained displacement (clockwise in FIG. 9) it holds the portion 153 counter to the spring effect of the arm 155 out of engagement with the edge 152. When the knob 15 is turned, however, that is when it is turned in counterclockwise direction in FIG. 1, the finger 159 releases the pawl 151, and irrespective of the momentary position of the segment 147 the pawl can engage and lock with the same, or it can slide on the edge 157. Immediately following the release of the pawl 151, the finger 159 additionally acts upon the arm 27 upon an abutment portion 160 on the arm 150. This abutment portion is displaceable in two opposite directions. In the direction of movement of the arm 27 the finger 159 moves into engagement with the first edge 161 which is a slide edge, and during further movement it displaces the segment 147 in the same direction and moves it from the respectively assumed momentary position of the segment 147 to its latchable starting position. Outside of the starting position, that is during each movement of the knob 15 from the rest position thereof, the indicating unit H can automatically be moved to a position indicating zero time and remain latched in this position until finally the knob 15 or the finger 159 has returned to the starting position. During the return movement of the knob 15 the finger 159 engages a second slide face 162 and displaces the segment 147 against the force of the spring 146 about the engagement of the gears 145, 137 which acts as a pivot point. To make this possible the hole 148 is constructed, as previously pointed out, of essentially kidney-shaped configuration that extends in the direction of the displacement movement. The points 9, 145 and 137, about which the finger 159 and the segment 157 move in an arcuate track, are so associated with one another that the rolling movement of the finger 159 on the edge 162, and the pivoting movement caused thereby, will have no functional influence on the latched segment 147 which is biased by the spring 146. During the terminal phase of the return movement of the finger 159, the latter engages the arm 158 of the pawl 151, displacing the same out of engagement with the segment 147 so that the segment can now return — following the urging of the spring 146—, in that it turns on the pivot 149 in a sense causing via the engagement of the gears 145, 137 the disc 134 to move into abutment with the pre-setting device 125 for the time selecting unit F. The time interval corresponding to the sensed value of the coin M has now been set and indicated, and the parking meter will begin to count back towards zero from this selected time interval, and will indicate the expired It will be understood that each of the elements described above, or two or more together, may also find a useful application in other types of constructions differing from the types described above.

While the invention has been illustrated and described as embodied in a parking meter, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an apparatus for timing intervals of varying magnitude, particularly in a parking meter, a combination comprising manually operable first means which is continually biased to a starting position and turnable from the same to an operating position; second means associated with said first means and operative for receiving a coin, and for determining the value of the coin in response to turning of said first means towards said operating position; third means operatively connected with said first and second means for presetting, during turning of said first means to said operating position, a time interval of a magnitude which depends upon the coin value determined by said second means; fourth means operatively connected with said first and third means for indicating the magnitude of the preset time interval in response to returning of said first means to said starting position thereof, wherein said fourth means is movable between a null position and a plurality of time-interval indicating positions; and further comprising means for moving said fourth means to said null position in response to turning of said first means from said starting position to said operating position thereof.

2. A combination as defined in claim 1, wherein said fourth means comprises a fixed scale carrying time markings, and a dial mounted adjacent said scale and turnable relative to the same between said null position and said plurality of indicating positions in which it overlies respective portions of said scale.

3. In an apparatus for timing intervals of varying magnitude, particularly in a parking meter, a combination comprising manually operable first means which is continually biased to a starting position and turnable from the same to an operating position; second means associated with said first means and operative for receiving a coin, and for determining the value of the coin in response to turning of said first means towards said operating position; third means operatively connected with said first and second means for presetting, during turning of said first means to said operating position, a time interval of a magnitude which depends upon the coin value determined by said second means; fourth means for indicating the magnitude of the preset time interval in response to returning of said first means to said starting position thereof, said fourth means being movable between a null position and a plurality of time-interval indicating positions; and means for moving said fourth means to said null position in response to turning of said first means from said starting position to said operating position thereof, said fourth means comprising a fixed scale carrying time markings, a dial having an abutment portion and being mounted adjacent to the scale turnable relative to the same between said null position and said plurality of indicating positions in which it overlies respective portions of said scale, a shaft mounting said dial and being provided with gear teeth, means tending to turn said dial to said indicating positions, including a pivotable segment meshing with said gear teeth, and biasing means continually tending to pivot said toothed segment in a direction in which it turns said shaft and said dial to said indicating positions, said third means including a movable abutment which is preset during operation of said third means and which is engaged by said abutment portion when said dial turns towards said indicating positions, whereby a respective indicating position is selected.

4. A combination as defined in claim 3; and further comprising a spring-biased pawl which arrests said segment and prevents pivoting of the same in said direction unless said first means is in said starting position.

5. A combination as defined in claim 4, said segment having a projecting arm; and said first means including a finger arranged to engage said arm and move said segment into arresting engagement with said pawl in response to turning of said first means out of said starting position.

6. A combination as defined in claim 5, said pawl being spring-biased toward arresting engagement with said segment and having a free arm portion; and wherein said free arm portion is located in the path of movement of said finger for engagement by the same in response to returning of said first means to said starting position thereof, so as to disengage said pawl from said segment.

7. A combination as defined in claim 5, said segment being formed with a substantially kidney-shaped mounting hole in which a stationary pivot is received with clearance, so that said segment is movable on and transversely of said pivot.

* * * * *